US006402305B1

(12) United States Patent
Chwalek et al.

(10) Patent No.: US 6,402,305 B1
(45) Date of Patent: Jun. 11, 2002

(54) METHOD FOR PREVENTING INK DROP MISDIRECTION IN AN ASYMMETRIC HEAT-TYPE INK JET PRINTER

(75) Inventors: James M. Chwalek, Pittsford; David L. Jeanmaire, Brockport, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/470,728

(22) Filed: Dec. 22, 1999

Related U.S. Application Data

(63) Continuation-in-part of application No. 08/954,317, filed on Oct. 17, 1997, now Pat. No. 6,079,821.

(51) Int. Cl.[7] ..... B41J 2/105

(52) U.S. Cl. ..... 347/82; 347/46; 347/75

(58) Field of Search ..... 347/46, 20, 54, 347/57, 26, 80, 75, 73, 74, 77, 82, 47, 10, 11, 70

(56) References Cited

U.S. PATENT DOCUMENTS

| | | | | |
|---|---|---|---|---|
| 1,941,001 A | | 12/1933 | Hansell | 178/96 |
| 3,373,437 A | | 3/1968 | Sweet et al. | 347/74 |
| 3,416,153 A | | 12/1968 | Hertz et al. | 347/73 |
| 3,709,432 A | | 1/1973 | Robertson | 118/315 |
| 3,878,519 A | | 4/1975 | Eaton | 347/75 |
| 3,916,421 A | | 10/1975 | Hertz | 347/75 |
| 3,979,756 A | | 9/1976 | Helinski et al. | 347/75 |
| 4,148,718 A | | 4/1979 | Fulwyler | 209/3.1 |
| 4,230,558 A | | 10/1980 | Fulwyler | 209/3.1 |
| 4,318,483 A | | 3/1982 | Lombardo et al. | 209/3.1 |
| 4,346,387 A | | 8/1982 | Hertz | 347/75 |
| 4,555,713 A | * | 11/1985 | Ishima | 347/77 |
| 4,646,106 A | | 2/1987 | Howkins | 347/9 |
| 4,973,980 A | * | 11/1990 | Howkins et al. | 347/70 |
| 5,160,939 A | | 11/1992 | Bajeux et al. | 347/78 |
| 6,126,260 A | * | 10/2000 | Lan et al. | 347/11 |

FOREIGN PATENT DOCUMENTS

| | | |
|---|---|---|
| EP | 0764527 | 3/1997 |
| EP | 0911168 | 4/1999 |

* cited by examiner

*Primary Examiner*—N. Le
*Assistant Examiner*—Matthew T. Welker
(74) *Attorney, Agent, or Firm*—Walter S. Stevens

(57) ABSTRACT

A method for preventing the misdirection of the initial ink droplets discharged from the nozzle of an asymmetric heat-type ink jet printer is provided. The method includes the step of providing power to the heating element that is adjacent to the inkjet nozzle at a higher level than the level normally used during the printing operation. When the power is supplied to the heater in the form of a train of electrical pulses, at least the first electrical pulse has at least one of a greater amplitude, width, or frequency at the beginning of the printing operation than the amplitude, width, and frequency normally used during the printing operation. The method enhances resolution by avoiding the off-target deflection of ink droplets that may happen at the beginning of a printing operation as a result of thermal inertia in the region of the heater and nozzle.

20 Claims, 6 Drawing Sheets

METHOD FOR PREVENTING INK DROP MISDIRECTION IN AN ASYMMETRIC HEAT-TYPE INK JET PRINTER

CROSS REFERENCE TO RELATED APPLICATIONS

This application is a continuation-in-part of U.S. patent application Ser. No. 08/954,317 filed Oct. 17,1997 now U.S. Pat. No. 6,079,821 and assigned to the Eastman Kodak Company.

FIELD OF THE INVENTION

This invention generally relates to a method of supplying power to a continuous ink jet printhead that maintains a proper directionality of a stream of droplets at the beginning of a printing operation.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical presses, even though this conventional method requires very expensive set up and is seldom commercially viable unless a few thousand copies of a particular page are to be printed. Thus, there is a need for improved digitally controlled printing systems that are able to produce high quality color images at a high speed and low cost using standard paper.

Inkjet printing is a prominent contender in the digitally controlled electronic printing arena because, e.g., of its non-impact low-noise characteristics, its use of plain paper, and its avoidance of toner transfers and fixing. Ink jet printing mechanisms can be categorized as either continuous ink jet or drop on demand inkjet. Continuous inkjet printing dates back to a least 1929. See U.S. Pat. No. 1,941,001 to Hansell.

Conventional continuous ink jets utilize electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium.

A novel continuous inkjet printer is described and claimed in U.S. patent application Ser. No. 08/954,317 filed Oct. 17, 1997, and assigned to the Eastman Kodak Company. Such printers use asymmetric heating in lieu of electrostatic charging tunnels to deflect ink droplets toward desired locations on the recording medium. In this new device, a droplet generator formed from a heater having a selectively-actuated section associated with only a portion of the nozzle bore perimeter is provided for each of the ink nozzle bores. Periodic actuation of the heater element via a train of uniform electrical power pulses creates an asymmetric application of heat to the stream of droplets to control the direction of the stream between a print direction and a non-print direction.

While such continuous ink jet printers have demonstrated many proven advantages over conventional ink jet printers utilizing electrostatic charging tunnels, the inventors have noted certain areas in which such printers may be improved. In particular, the inventors have noted that at the beginning of a printing operation, the first few droplets directed toward the printing medium may be misdirected. While the cause of such droplet misdirection is not entirely understood, the applicants speculate that the principle cause is the non-instantaneous thermal response time of the ink to reach a quasi-equilibrium (operational) temperature since the amount of the drop deflection is directly related to the temperature of the fluid. The duration of the response time is a function of the thermal properties of the heater material, the heater mass, the heater and nozzle geometry as well as the thermal properties of the ink. Any such misdirected droplets can interfere with the objective of obtaining high image 5 quality printing from such devices.

SUMMARY OF THE INVENTION

It is an object of the present invention to provide a continuous ink jet method of printing that maximizes print resolution by preventing the misdirection of ink droplets at the beginning of a printing operation.

It is another object of the present invention to provide a continuous ink jet printing method that prevents ink drop misdirection which may be used in an asymmetric heat-type printer without the need for making structural changes in such a printer.

Both of these objects are realized by the method of the invention, which generally comprises the step of supplying power to the heating element that is adjacent to the nozzle at a higher level than normal during the ejection of the first few ink droplets from the nozzle.

During normal printing operations, power pulses conducted to the heating element adjacent to each nozzle are comprised of a train of pulses having a constant amplitude, width, and frequency. In the method of the invention, at least one of the electrical characteristics of the pulse train is changed so that power is supplied to the heating element at a higher level than the constant operational level. Accordingly, the initial pulse or pulses have either a greater amplitude or width or a different frequency than the electrical pulses used during the balance of the printing operation.

In the embodiment of the method wherein the amplitude of the initial electrical pulses is increased, at least the first power pulse may have an amplitude between about 10% and 60% greater than the amplitude of a normal, operational power pulse. Alternatively, at least the first power pulse may have a width that is between about 60% and 300% more than the width of an operational power pulse. In still another embodiment of the method, the time interval between the first two pulses may be reduced to between about 25% and 50% of the time interval between subsequent operational power pulses. In all of the preferred embodiments, no more than about the first four power pulses have one of a greater amplitude, width, or a higher frequency than the balance of the power pulses used during the printing operation.

In the embodiment of the method wherein the first power pulse has an amplitude of between about 10% and 50% greater than the amplitude of an operational power pulse, the time period between the second power pulse and a third power pulse may be between about 10% and 100% greater than the time period associated with the operational power pulses.

In all of the embodiments of the invention, the method may be implemented simply by adjusting or reprogramming the shape or frequency of the power pulses generated by the power supply of the ink jet printer. The method is capable of substantially reducing, if not eliminating entirely, spurious ink drop deflection occurring at the beginning of a printing operation. Hence, the resolution of the final printing product is improved.

BRIEF DESCRIPTION OF THE DRAWINGS

In the detailed description of the preferred embodiments of the invention presented below reference is made to the accompanying drawings in which:

FIGS. 2(*b*) and 2(*c*) are plan views of nozzles with two different types of asymmetric heaters.

DETAILED DESCRIPTION OF THE INVENTION

The inventive method is implemented by a continuous ink jet printer system that uses an asymmetric application of heat around an ink jet nozzle to achieve a desired ink drop deflection. In order for the method to be concretely understood, a description of the ink jet printer system 1 that carries out the method steps will first be given.

Figure 1:
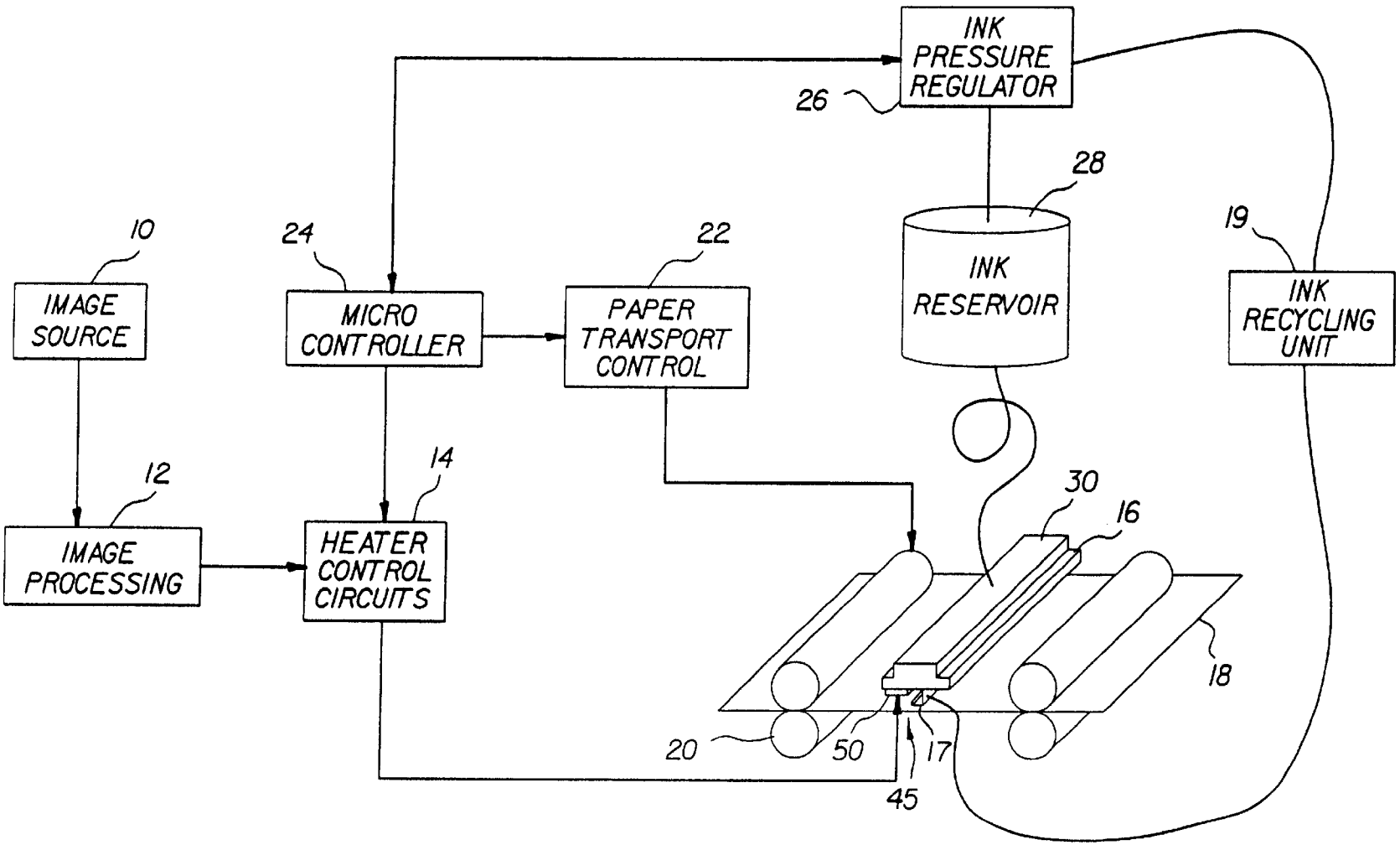
FIG. 1 is simplified block schematic diagram of one exemplary printing apparatus according to the present invention.

Referring to FIG. 1, an asymmetric heat-type continuous ink jet printer system 1 includes an image source 10 such as a scanner or computer which provides raster image data, outline image data in the form of a page description language, or other forms of digital image data. This image data is converted to half-toned bitmap image data by an image processing unit 12 which also stores the image data in memory. A heater control circuit 14 reads data from the image memory and applies electrical pulses to a heater 50 that surrounds a nozzle bore 46 that is part of a printhead 16. These pulses are applied at an appropriate time, and to the appropriate nozzle bore 46, so that drops formed from a continuous ink jet stream will print spots on a recording medium 18 in the appropriate position designated by the data in the image memory.

Recording medium 18 is moved relative to printhead 16 by a recording medium transport system 20 which is electronically controlled by a recording medium transport control system 22, and which in turn is controlled by a microcontroller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 28 under pressure. In the nonprinting state, continuous ink jet drop streams are unable to reach recording medium 18 due to an ink gutter 17 (also shown in FIG. 2(*a*)) that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the heaters 50 and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface where a plurality of nozzles and heaters are situated. With printhead 16 fabricated from silicon, it is possible to integrate heater control circuits 14 with the printhead.

Figure 2:
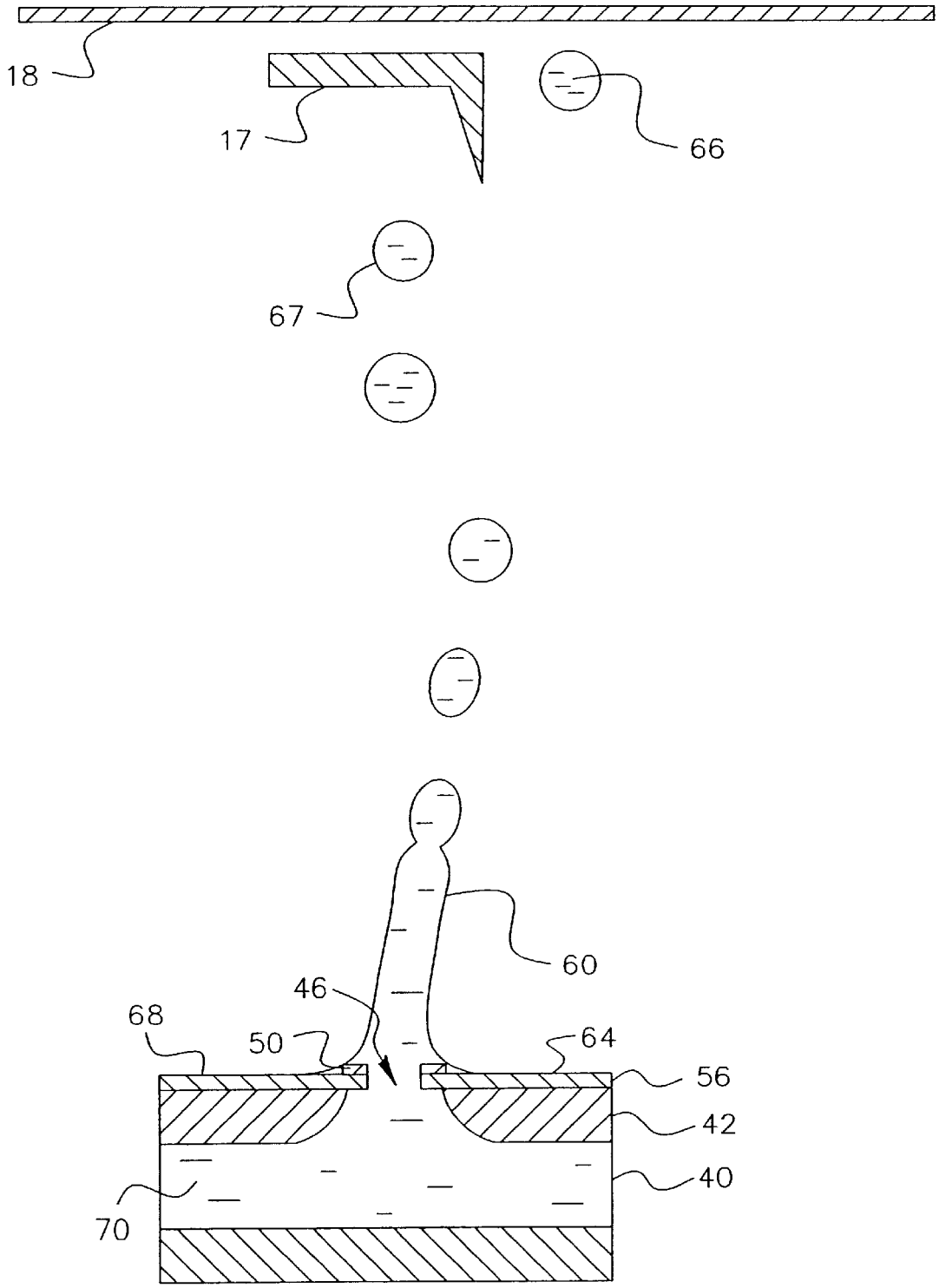
FIG. 2(*a*) is a cross sectional view of a nozzle with asymmetric heating deflection in operation.
Figure 2:
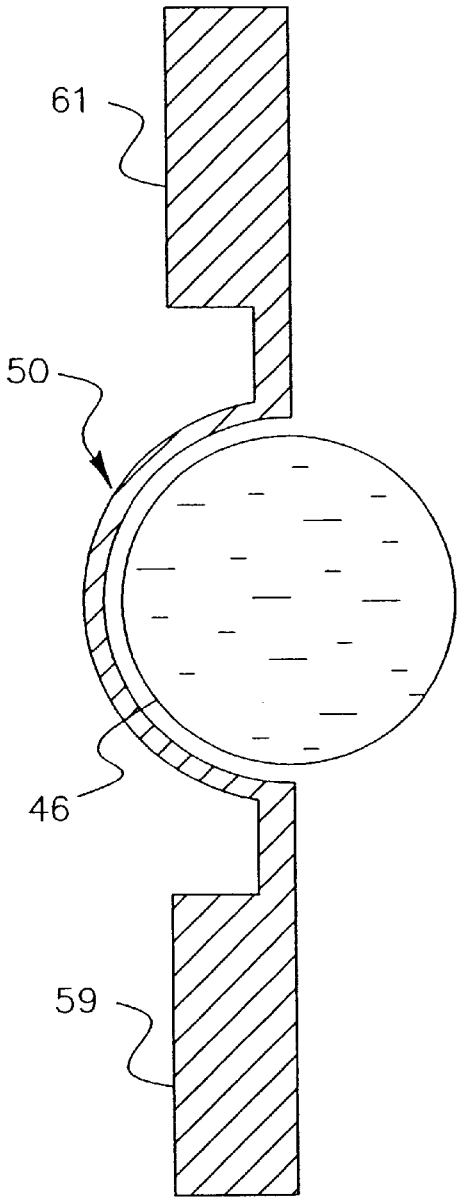
Figure 2:
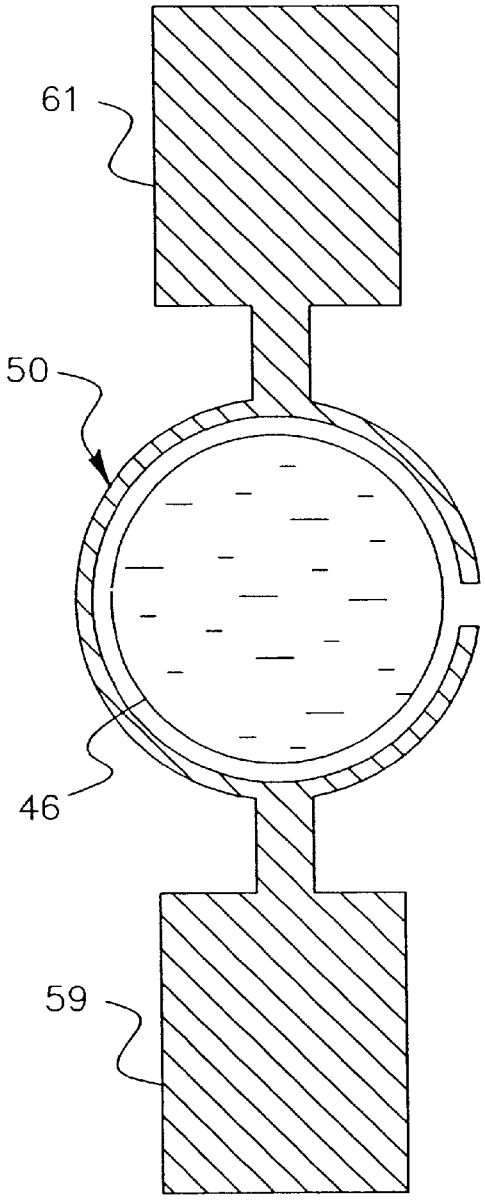

FIG. 2(*a*) is a cross-sectional view of a nozzle bore 46 in operation. An array of such nozzle bores 46 form the continuous ink jet printhead 16 of FIG. 1. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to heat supplied by a heater 50.

With reference now to FIG. 2(*b*), the heater 50 has a single semicircular section covering approximately one-half of the nozzle perimeter. An alternative geometry is shown in FIG. 2(*c*). In this geometry the nozzle bore 46 is almost entirely surrounded by the heater 50 except for a small missing section 51 that acts as an electrical open circuit such that only approximately one-half of the heater 50 is electrically active since the current flowing between connections 59 and 61 needs to travel only around the left half of the annulus to complete the active circuit. In both embodiments, power connections 59 and 61 transmit electrical pulses from the heater control circuits 14 to the heater 50. Stream 60 may be deflected by the asymmetric application of heat generated on the left side of the nozzle bore by the heater section 50. This technology is distinct from that electrostatic continuous stream deflection printers which rely upon deflection of charged drops previously separated from their respective streams. With stream 60 being deflected, drops 67 may be blocked from reaching recording medium 18 by a cut-off device such as an ink gutter 17. In an alternate printing scheme, ink gutter 17 may be placed to block deflected drops 66 so that undeflected drops 67 will be allowed to reach recording medium 18.

The heater 50 may be made of polysilicon doped at a level of about 30 ohms/square, although other resistive heater materials could be used. Heater 50 is separated from substrate 42 by thermal and electrical insulating layer 56 to minimize heat loss to the substrate. The nozzle bore 46 may be etched allowing the nozzle exit orifice to be defined by insulating layers 56.

The layers in contact with the ink can be passivated with a thin film layer 64 for protection. The printhead surface can be coated with a hydro-phobizing layer 68 to prevent accidental spread of the ink across the front of the printhead.

Heater control circuit 14 supplies electrical power to the heater 50 shown in FIG. 2(*a*) in the form of an electrical pulse train. Control circuit 14 may be programmed to supply power to the semicircular section of the heater 50 in the form of pulses of uniform amplitude, width, and frequency or varying amplitude, width, or frequency in order to implement the steps of the inventive method. Deflection of an ink droplet occurs whenever an electrical power pulse is supplied to the heater 50.

Figure 3:
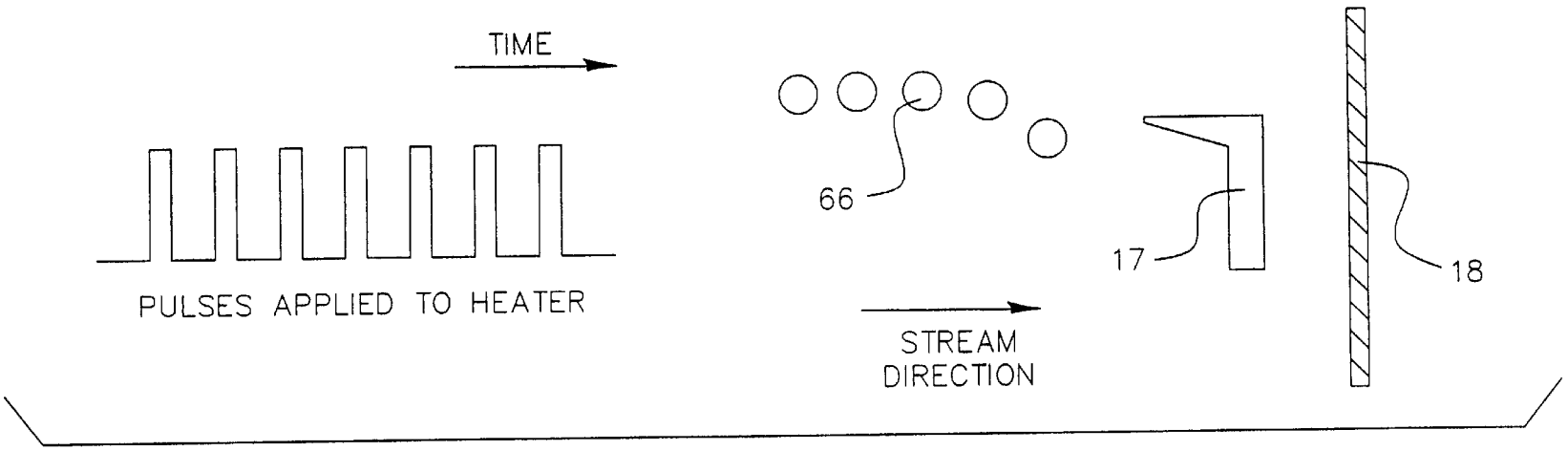
FIGS. 3(*a*) and 3(*b*) illustrate the difference in trajectory of initially discharged droplets when the method is not used and when the method is used, respectively.
Figure 3:
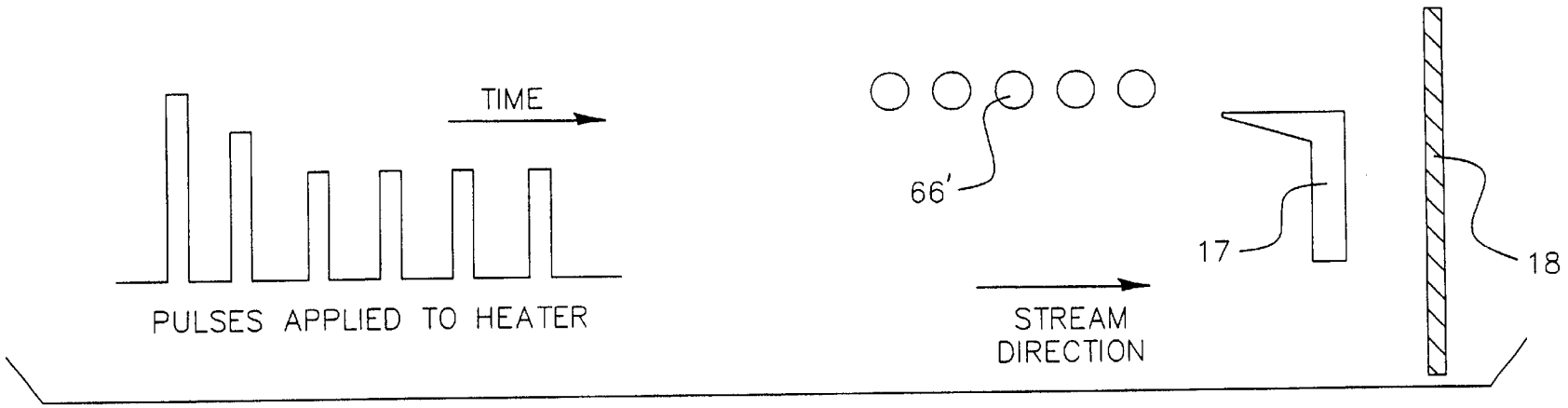

FIG. 3(*a*) illustrates a series of deflected drops 66 produced by the six electrical pulses shown on the left-hand side of the figure which have uniform amplitude, frequency, and width. They are shown as they approach the gutter 17. This Figure may be considered an enlarged view of the area surrounding the gutter 17 depicted in FIG. 2(*a*). A minimum of two pulses is required to form the first drop. Each additional drop is formed by an additional electrical pulse. However, due to the thermal lag the first drop is not deflected as far as the subsequent drops. In this example, the same can be said for the second drop although its deflection does not lag as far as did the first. By the third drop and thereafter the drops have reached their operational deflection point and are deflected essentially by the same amount. As can be seen from FIG. 3(*a*) the first two print drops as drawn will likely strike the leading edge of the gutter causing either the drops to miss the recording medium 18 completely or causing the drops to break into smaller droplets (spatter) and strike the recording media 18 in an unpredictable manner. Even if all of the drops reach the recording media 18 without spatter, it is possible that the first two drops will strike the recording media 18 at locations different from the subsequent drops. In either case, image quality will suffer.

FIG. 3 (*b*) illustrates a series of deflected drops 66' produced by the six electrical pulses shown on the left-hand side of the figure which are generated in accordance with one of several embodiments of the method of the invention. In this example, the pulses of the invention are characterized by a higher amplitude or voltage for the first two pulses. The additional power initially delivered by the first two pulses overcomes the thermal lag associated with the nozzle 50 and ink and results in a uniform deflection of all of the print drops 66' as they are discharged in route to the recording medium 18, thereby overcoming the drop lag shown in FIG. 3(*a*). Various pulse patterns in accordance with the method of the invention are discussed in detail hereinafter with respect to FIGS. 4(*a*)–(*f*).

Figure 4:
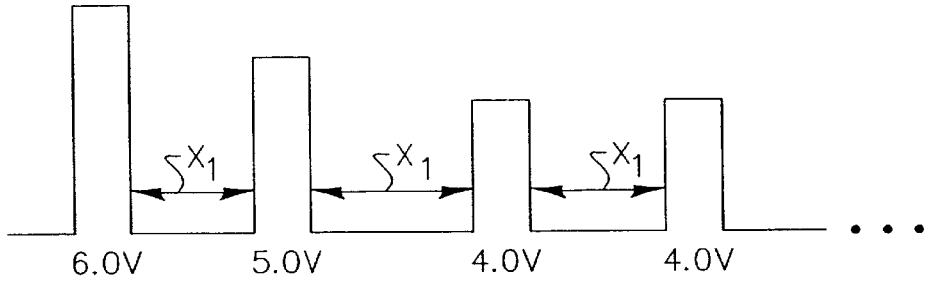
FIGS. 4(*a*)–4(*f*) illustrate six different pulse trains embodying the method of the invention.
Figure 4:
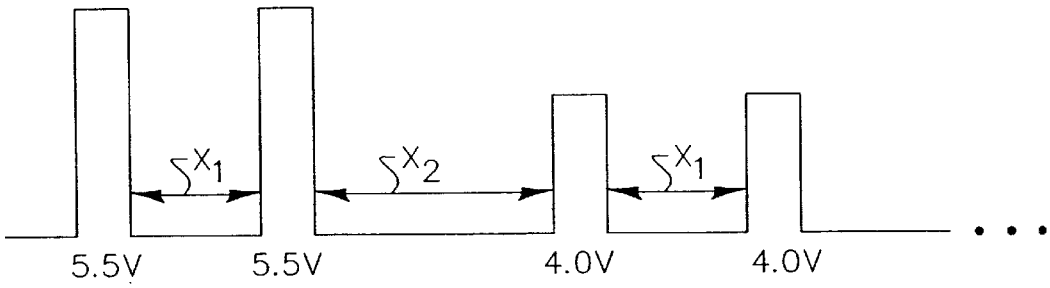
Figure 4:
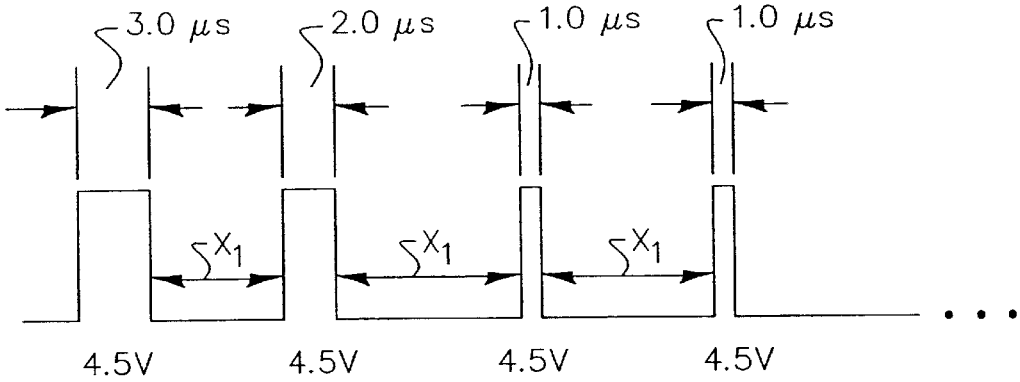
Figure 4:
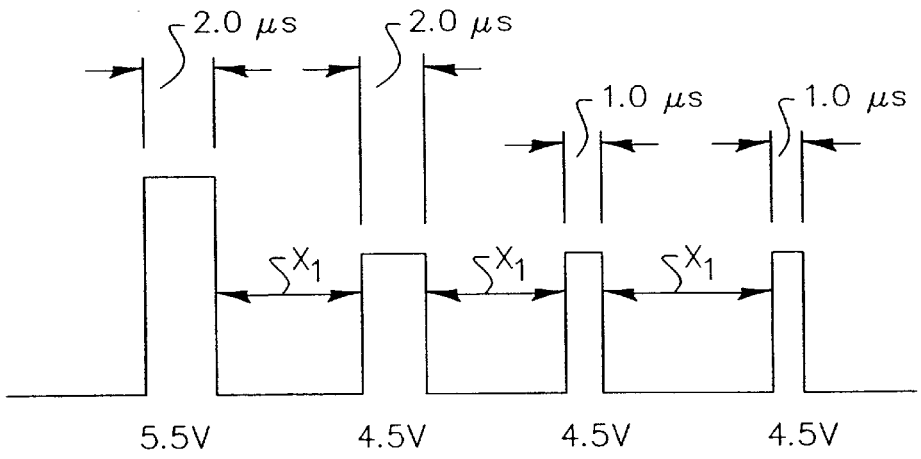
Figure 4:
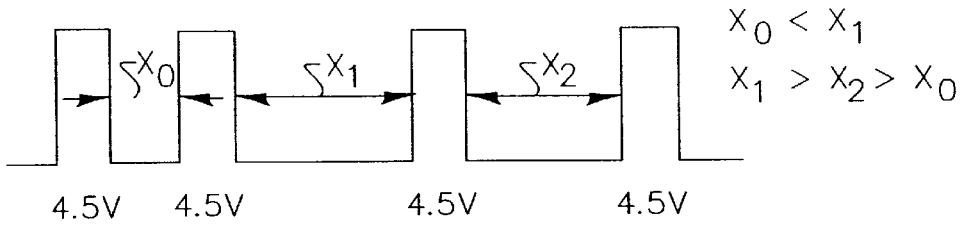
Figure 4:
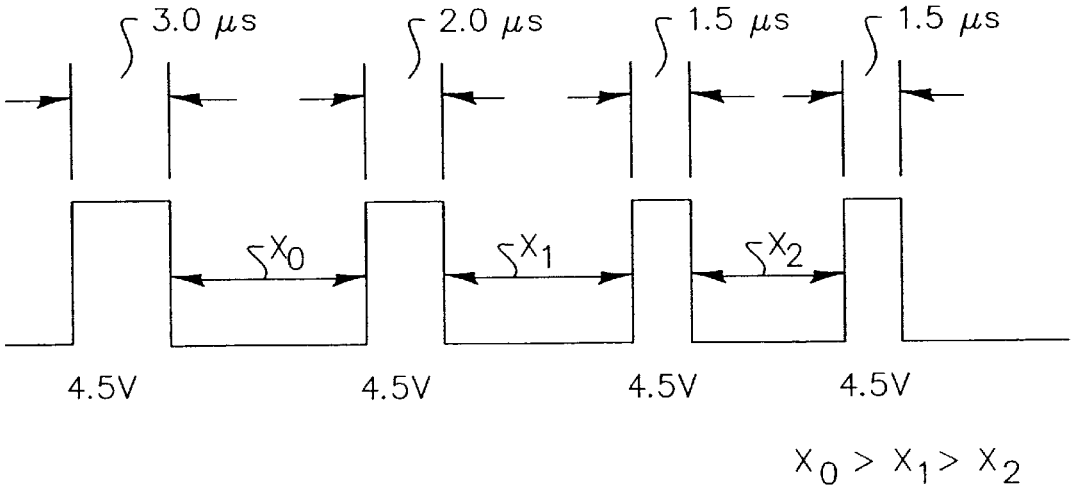

FIGS. 4(*a*)–4(*f*) illustrate different preferred embodiments of the pulses train of the invention. While in some cases (such as those illustrated in FIGS. 4(*b*) and 4(*f*)) the relatively higher amount of power delivered to the heater 50 as a result of the higher amplitude or larger width of the first one or two pulses may be partially offset by a longer time period between the first pulses. Conversely, if a somewhat lower amplitude or shorter widths are desired then the time period between the first pulses may be shortened as shown in FIG. 4(*e*). Conversely, in all of the various embodiments of the invention, more electrical energy is initially delivered to the heater 50 than would otherwise be the case if only operational power pulses were initially supplied to the heater. It is important to note that the exact values of the waveform amplitudes, widths, and frequencies that provide the optimum drop deflection alignment and image quality will depend on a number of factors including heater geometry and resistance, nozzle geometry, and ink. Also, what may be optimal for a particular printhead geometry and ink may not be optimal for a different printhead geometry and ink. Also, there may exist more than one set of pulses that may produce similar results for the same printhead and ink combination.

In the first embodiment of the method illustrated in FIG. 4(*a*), the voltage of the first pulse is 6.0 V, the voltage of the second pulse is 5.0 V, and the voltage of the remaining pulses used to carry out the remainder of the printing operation is only 4.0 V. The time period between the pulses $x_1$, is identical, i.e., the frequency between the pulses is constant at all times. The width of each of the pulses is also the same. In practice, the pulse width may be between, for example, 1.0 to 3.0 microseconds, while the frequency may be for example 150 KHz. The peak power supplied to the heater may be approximately 90 milliwatts for the first pulse, 62.5 milliwatts for the second pulse, and 40 milliwatts for each pulse thereafter. The results of such a waveform on the drop stream is illustrated in FIG. 3(*b*). In this case, the first two drops 66 are now aligned with respect to one another and all of the drops will completely clear the gutter 17. This will allow all of the drops 66 to strike the receiver 18 and will eliminate image quality degradation due to missed drops, spattered drops or misdirected drops. The situation should be contrasted with that of FIG. 3(*a*).

FIG. 4(*b*) illustrates an embodiment of the invention where the amplitude of the first two pulses is the same (5.5 V in the example) and that the time period $x_2$ between the second and third pulses is longer than the time period $x_1$, between all of the other pulses. Time period $x_2$ may be, for example, 10% and 50% larger than the balance of the time delays $x_1$. FIG. 4(*b*) illustrates that in order to achieve optimal correction when utilizing only two amplitude levels it may be necessary to vary the time delay between pulses.

FIG. 4(*c*) illustrates an embodiment of the invention wherein only the width of the first two pulses is enlarged. Specifically, the width of the first two pulses is 3.0 microseconds, while the width second pulse is 2.0 microseconds, while the width of the remaining pulses used during the printing operation is 1.0 microseconds. The time period $x_1$, between each of the pulses remains identical. Embodiments of the invention which change only the width of the initially-generated power pulses are somewhat preferred over those which enlarge the height of these pulses since the use of a single voltage simplifies the drive circuitry.

FIG. 4(*d*) illustrates an embodiment of the invention wherein a combination of amplitude and width are changed to apply a greater amount of power to the heater 50 in the initial print operation. The amplitude of the first pulse is increased to 5.5 V while the amplitude of the remaining pulses is the same at 4.5 V. The width of the first two pulses is the same at 2.0 microseconds while the width of subsequent pulses is 1.0 microseconds. Note that the total energy of each of the pulses, including the first pulse has not changed from that given in FIG. 4(*c*). Additionally, the time period between each of the pulses $x_1$, is the same as indicated.

FIG. 4(*e*) illustrates an embodiment of the method of the invention wherein the frequency of the first two pulses is higher than that of the subsequent pulses. Specifically, the time period $x_0$, between the first and second pulses is between 25% and 50% less than the time period between any of the remaining pulses. The time period between the second and third pulses $x_1$, is greater than the time period between the first and second pulses $x_0$. In a variation of this embodiment, a third time period $x_2$ may exist for all subsequent pulses. This time period is less than time period $x_1$, but greater than time period $x_0$. For example, if the time period between the first two pulses $x_0$ is 3 microseconds, the time period $x_1$, may be 7 microseconds while $x_2$ may be 5 microseconds.

Finally, FIG. 4(*f*) illustrates an embodiment of the method that combines varying pulse width with varying time period.

In general, varying both of these parameters may be necessary for optimal results. In this example of the method, the time periods $x_0$ and $x_1$, are actually larger than the time period $x_2$ used between the remainder of the pulses. Time period $x_2$ may be 7 microseconds, while time period $x_1$, may be 6 microseconds. The $x_2$ time period may be 5 microseconds. The width of the first pulse may be 3 microseconds, while the width of the second pulse may be 2 microseconds. The width of the remaining pulses may be 1.5 microseconds. Again, for reasons not entirely understood, the lengthening of the time period between the initially-generated pulses can sometimes result in better directionality over merely increasing either the height or 5 width of the first two pulses.

While the examples given thus far apply waveforms to the heater 50 that compensate for the first two misdirected drops, it is possible that the thermal response time may be such that more than two drops will need compensation. In this case the same techniques may be applied albeit with waveforms that apply greater energy in not just the first two pulse periods but to more than the first two pulse periods. For example, if the first four drops were in need of compensation, various combinations of pulse amplitude, width, and time periods as taught in this disclosure could be extended into the first four time periods.

Although an array of streams is not required in the practice of this invention, a device comprising an array of streams may be desirable to increase printing rates. In this case, deflection and modulation of individual streams may be accomplished as described for a single stream in a simple and physically compact manner, because such deflection relies only on application of a small potential, which is easily provided by conventional integrated circuit technology, for example CMOS technology.

The invention has been described in detail with particular reference to preferred embodiments thereof, but it will be understood that variations and modifications can be effected within the spirit and scope of the invention.

PARTS LIST

1. Printer system
10. Image source
12. Image processing unit
14. Heater control circuit
16. Printhead
17. Ink gutter
18. Recording medium
19. Ink recycling unit
20. Transport system
22. Transport control system
24. Micro-controller
26. Ink jet pressure regulator
28. Ink reservoir
30. Ink channel device
40. Ink delivery channel
42. Substrate
46. Nozzle bores
50. Nozzle heater
51. Meniscus
56. Electrical insulating layer
59. Connector
60. Stream
61. Connector
64. Thin passivation film
66. Drops (deflected)
67. Undeflected drops
68. Hydrophobizing layer
70. Ink
75. CMOS circuit
77. Shift register
79. Latch circuit
81. Latch clock
83. Enable clock
84. AND gate
85. Driver transistor
87. Driver transistor
89. AND gate
91. Memory circuit of micro-controller

What is claimed:

1. Method for controlling an initial flow of ink droplets from the nozzle of an ink jet printer at the start of a printing operation, wherein said printer has a heating element adjacent to said nozzle for directing said ink droplet flow that is supplied with power at a substantially constant level during said operation, comprising the step of:

supplying power to said heating element at a higher level than said constant operational level during said initial flow of ink droplets to avoid a misdirection of said initial droplet flow.

2. The method of controlling an initial flow of ink droplets as defined in claim 1, wherein power is supplied to said heating element in the form of a series of electrical pulses of constant amplitude, width, and frequency during said printing operation, and said step includes initially supplying power in the form of pulses having at least one of a greater amplitude, width, or frequency than said constant operational amplitude, width, or frequency.

3. The method of controlling an initial flow of ink droplets as defined in claim 2, wherein at least the first power pulse has an amplitude between about 10% and 60% greater than the amplitude of an operational power pulse.

4. The method of controlling an initial flow of ink droplets as defined in claim 3, wherein the first two power pulses have an amplitude between about 15% and 50% greater than the amplitude of an operational power pulse.

5. The method of controlling an initial flow of ink droplets as defined in claim 4, wherein the amplitude of said initial two power pulses is about 6.0 V, and the amplitude of subsequent operational pulses is 4.0 V.

6. The method of controlling an initial flow of ink droplets as defined in claim 3, wherein the time interval between the second and third pulses is between about 40% to 60% of the time interval between operational pulses.

7. The method of controlling an initial flow of ink droplets as defined in claim 2, wherein at least the first power pulse has a width that is between about 50% and 300% more than the width of an operational power pulse.

8. The method of controlling an initial flow of ink droplets as defined in claim 7, wherein the first two power pulses have a width that is between about 50% and 200% greater than the width of an operational power pulse.

9. The method of controlling an initial flow of ink droplets as defined in claim 7, wherein the first power pulse has a width of 3.0 $\mu$s, and subsequent operational power pulses have a width of 1.0 $\mu$s.

10. The method of controlling an initial flow of ink droplets as defined in claim 7, wherein the second power pulse has an amplitude that is between about 10% and 30% of the amplitude of an operational power pulse.

11. The method of controlling an initial flow of ink droplets as defined in claim 2, wherein the time interval between the first two pulses is between about 25% and 50% of the time interval between subsequent operational power pulses.

12. The method of controlling an initial flow of ink droplets as defined in claim 11, wherein the time interval between the first two pulses is between about 30% and 35% of the time interval between subsequent operational power pulses, and the time interval between the second and third pulse is about 60% and 70% of said time interval between subsequent operational power pulses.

13. Method for controlling the flow of initially discharged ink droplets from the nozzle of an ink jet printer at the start of a printing operation, wherein said printer has a heating element adjacent said nozzle for directing said ink droplet flow, said heating element being supplied with power pulses of substantially constant width, amplitude, and period during said printing operation, comprising the step of:

initially supplying power in the form of pulses having at least one of a greater width, greater amplitude, or shorter period than said constant operational width, amplitude, and period.

14. The method of controlling an initial flow of ink droplets as defined in claim 13, wherein at least the first power pulse has an amplitude between about 10% and 60% greater than the amplitude of an operational power pulse.

15. The method of controlling an initial flow of ink droplets as defined in claim 14, wherein the first two power pulses have an amplitude between about 15% and 50% greater than the amplitude of an operational power pulse.

16. The method of controlling an initial flow of ink droplets as defined in claim 13, wherein at least the first power pulse has a width that is between about 50% and 300% more than the width of an operational power pulse.

17. The method of controlling an initial flow of ink droplets as defined in claim 16, wherein the first two power pulses have a width that is between about 50% and 200% greater than the width of an operational power pulse.

18. The method of controlling an initial flow of ink droplets as defined in claim 13, wherein at least the first pulse but no more than the fourth pulse has at least one of a greater width, greater amplitude, and higher frequency than said constant operational width, amplitude, and frequency.

19. The method of controlling an initial flow of ink droplets as defined in claim 18, wherein the first power pulse has an amplitude of between about 10% and 40% greater than the amplitude of an operational pulse.

20. The method of controlling an initial flow of ink droplets as defined in claim 19, wherein the time period between the first two pulses and a third pulse is between about 10% and 100% greater than the time period associated with said constant operational period.

* * * * *